US005795491A

United States Patent [19]

Ciriaci

[11] Patent Number: 5,795,491

[45] Date of Patent: Aug. 18, 1998

[54] METHOD OF PRODUCING DECORATIVE LOUVER WINDOW COVERING MATERIAL

[76] Inventor: Piergiorgio Ciriaci, 6811 Falconsgate Ave., Davie, Fla. 33331

[21] Appl. No.: 614,491

[22] Filed: Mar. 13, 1996

[51] Int. Cl.[6] ..... B44C 1/22

[52] U.S. Cl. ..... 216/28; 264/132; 427/209

[58] Field of Search ..... 216/28; 264/132; 427/209

[56] References Cited

U.S. PATENT DOCUMENTS

| | | | |
|---|---|---|---|
| 4,877,077 | 10/1989 | Ebert | 160/236 |
| 4,884,615 | 12/1989 | Hsu | 160/236 |
| 4,906,170 | 3/1990 | Nelson et al. | 425/94 |
| 5,118,532 | 6/1992 | Batson et al. | 427/278 |
| 5,194,209 | 3/1993 | Schwaegerle | 264/132 |
| 5,263,529 | 11/1993 | Landis | 160/236 |
| 5,269,361 | 12/1993 | Ryden et al. | 160/236 |
| 5,281,290 | 1/1994 | Bosler | 156/230 |
| 5,496,630 | 3/1996 | Hawrylko et al. | 428/328 |
| 5,613,542 | 3/1997 | Tuzmen et al. | 160/236 |

*Primary Examiner*—Robert Kunemund
*Assistant Examiner*—Anita Alanko

[57] ABSTRACT

A method for producing a decorative louver window covering material includes extruding a heated thermoplastic composition from an extrusion apparatus to form a profile of continuous length having opposite surfaces, pulling the profile at a predetermined tension along a straight path of travel, partially cooling the profile, applying at least one pigmented liquid ink composition directly to one or both of the opposite surfaces of the profile to produce a design or pattern thereon, drying the ink on the profile, and cutting the profile into segments of predetermined length.

10 Claims, 5 Drawing Sheets

METHOD OF PRODUCING DECORATIVE LOUVER WINDOW COVERING MATERIAL

BACKGROUND OF THE INVENTION

1. Field of the Invention

The present invention relates to a method for producing decorative louver window covering materials and, more specifically, to a method of producing louver vanes having a printed ink design or pattern on at least one side thereof.

2. Description of the Related Art

Louvered window covering assemblies such as vertical blinds, venetian blinds, mini-blinds and the like are quite popular and well-known in the window covering art. In order to maintain an increasing demand for louvered window covering assemblies, the industry is constantly seeking new ways to enhance the decorative appearance of louver vanes in a cost-effective manner. In the past, various fabrics have been laminated to plain polyvinyl chloride vanes to dress them up and match the decor in a room or office. Other methods have included embossing the exterior surfaces of louver vanes to create a decorative pattern thereon. Such methods have included embossing the surface of an extruded slat or profile formed of a thermoplastic material as well as embossing a non-woven polyester web which has been impregnated with a pigmented thermoplastic resin composition, as disclosed in the U.S. Pat. to Batson, et al., No. 5,118,532. More recent methods include applying a printed ink design or pattern to one or more surfaces of a thermoplastic louver vane using a heat transfer method, wherein a printed design on a transfer sheet is released onto the surface of the thermoplastic louver vane. This particular method has become quite popular in the industry, as it permits multi-colored, detailed and highly decorative designs to be applied on the surface of a polyvinyl chloride louver vane.

However, the heat transferring method, requiring the use of heat transfer paper, is expensive and produces a great deal of waste. The production of decorative louver vanes using the heat transfer method requires buying large quantities of heat transfer paper having printed designs thereon from a supplier. The cost of the paper is considerably expensive and is limited to available designs. In order to produce custom designs, manufacturers of louver vanes must commit to large quantities from transfer paper suppliers, rendering the process even more expensive, especially if the designs do not sell very well.

Accordingly, there still exists a need in the window covering industry for a less expensive method of applying a highly detailed and decorative printed design directly to the exterior surface or surfaces of louver vanes for use as vertical blinds, venetian blinds, mini-blinds and the like.

SUMMARY OF THE INVENTION

In view of the foregoing, it is a primary object of the present invention to provide a method for producing a decorative louver vane for a window covering assembly, wherein a printed ink design comprising one or more colors is applied directly to at least one surface of the vane using a printing apparatus.

It is a further object of the present invention to provide a method of producing a decorative louver vane in an in-line production assembly, wherein the vane is first extruded as a profile of continuous length and, thereafter, partially cooled prior to applying at least one liquid ink composition directly thereto to produce a design or pattern thereon.

It is still a further object of the present invention to provide a method of applying a multi-colored, detailed decorative design to at least one surface of an extruded louver vane which is cost-effective and which can be performed in an in-line extrusion production assembly.

It is still a further object of the present invention to provide a method for producing a decorative louver vane, wherein an ink design is printed directly on at least one surface of the vane in a manner which is more efficient and more cost productive than heat transferring methods known in the related art.

To achieve the objects and advantages in accordance with the purpose of the present invention, as embodied and broadly described herein, a method for producing a decorative louver vane for window coverings includes extruding a heated thermoplastic composition from an extrusion apparatus to form a profile of continuous length. The extruded profile is pulled along a sizing table, under a predetermined tension, so that the continuous length of extrusion profile travels along a straight path. The profile is partially cooled as it travels along one or more of the sizing tables in an in-line production assembly. After partial cooling, the straight path of travel of the profile leads to one or more printing apparatus which are structured and disposed to apply at least one pigmented liquid ink composition directly to one or both of the opposite surfaces of the profile in order to produce a determined design or pattern thereon. Thereafter, the ink applied to the profile is dried, using blowers, prior to being cut into segments of predetermined length. The cut segments are deposited onto a dump table which drops the segments or vanes into a catch bin or box for packaging.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The method of the present invention will now be described in more detail with reference to the several views of the drawings.

Figure 1:
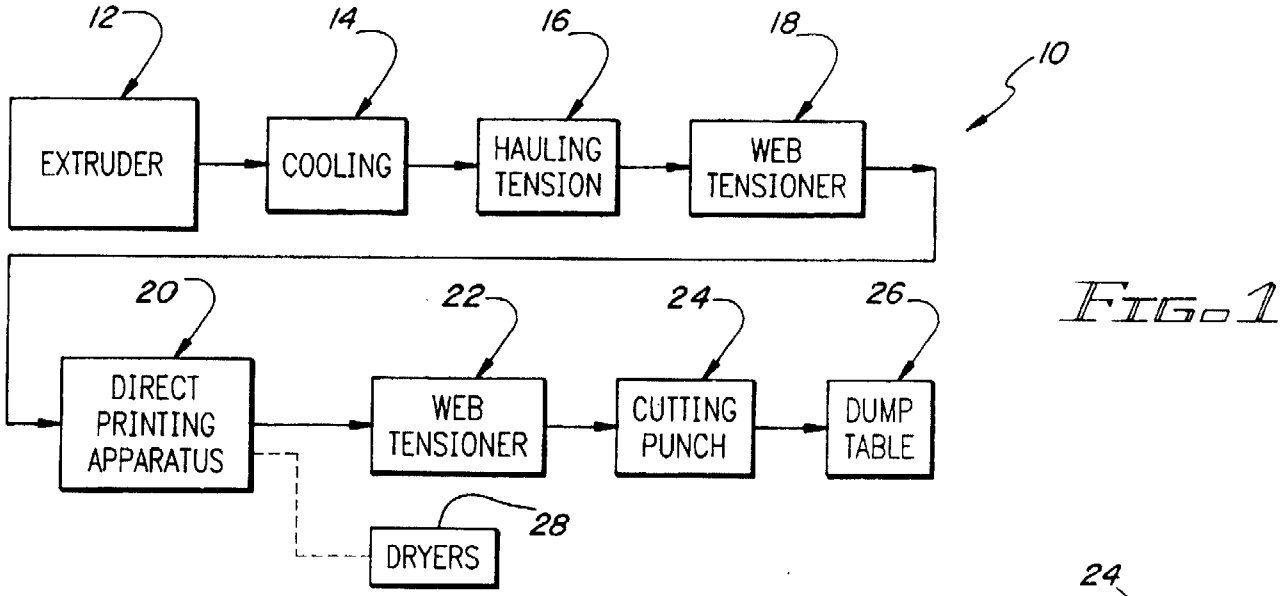
FIG. 1 is a block diagram illustrating the various stages of the production assembly in accordance with the method of the present invention.
Figure 4:
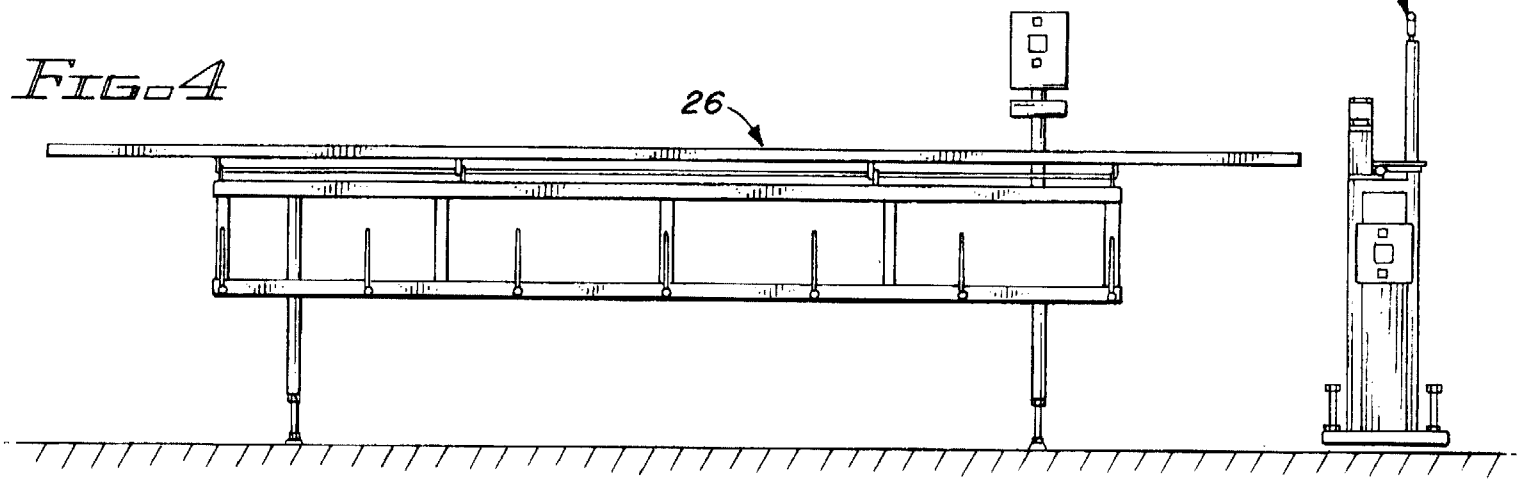
FIG. 4 is a side elevation which generally illustrates the cutting punch and dump table in the in-line production assembly.

Referring initially to FIG. 1, a block diagram generally illustrates the various stages of the in-line production assembly 10 in accordance with a preferred embodiment of the method for producing a decorative window covering product. A profile of continuous length and formed of a heated thermoplastic material is extruded from an extruder 12 in the direction indicated by the arrows in FIG. 1. The profile is cooled by blowers 14 as it is pulled along a straight path of travel, as indicated by the arrows, by a hauling tension apparatus 16. The amount of hauling tension applied by the apparatus 16 will, to some degree, determine the thickness and width of the profile; the initial configuration of which is defined by a die head at the extruder 12.

The hauling tension apparatus 16 directs the profile to a first web tensioner 18 which controls and regulates speed of movement of the profile through a printing apparatus 20 comprising one or more direct printing machines which apply one or more ink compositions directly to the top and/or bottom surface of the profile by conventional printing methods including, but not limited to, gravure printing, flexographic printing, rotary screen printing, or valley printing. A second web tensioner 22 engages the printed profile at an opposite end of the printing apparatus 20. The first web tensioner 18 and second web tensioner 22 act in unison to regulate the speed of movement and tension of the profile moving through the printing apparatus 20.

A cutting punch 24 cuts the profile into segments of predetermined length for use as window covering materials such as vertical, horizontal, venetian or mini-blinds. The lengths of segments are deposited onto a dump table 26 which periodically spills the lengths into a holding bin, packaging box, or the like.

In order to promote drying of the ink applied to the surface or surfaces of the profile, dryers 28 may be installed along the production assembly 10 just after the printing apparatus 20. The dryers 28 direct hot air onto the printed surfaces of the profile to dry the ink before reaching the cutting punch 24.

In a preferred embodiment, the thermoplastic material is a rigid polyvinyl chloride composition specifically structured to comply with industry specifications to resist cupping, shrinkage, waviness, stretching, warping, and bending when unexposed to hot and cold temperatures within predetermined temperature ranges.

Further, in the preferred embodiments, the inks applied directly to the surfaces of the extruded profile consist of urethane modified acrylic emulsion polymer resins, pigments, and surfactants stabilized with n-methyl pyrolidone. The ink compositions have been specifically developed to provide adhesion, washability, and decorative features to fabricated polyvinyl chloride surfaces. The ink compositions, available from Polytex Environmental Inks Ltd. of Bronx, N.Y., include coalescing agents, such as ethylene glycol ether derivatives to provide adhesion to rigid polyvinyl chloride surfaces. Specifically, the coalescing agents etch the surface of the polyvinyl chloride profile to promote adhesion to an otherwise non-porous surface.

Figure 2:
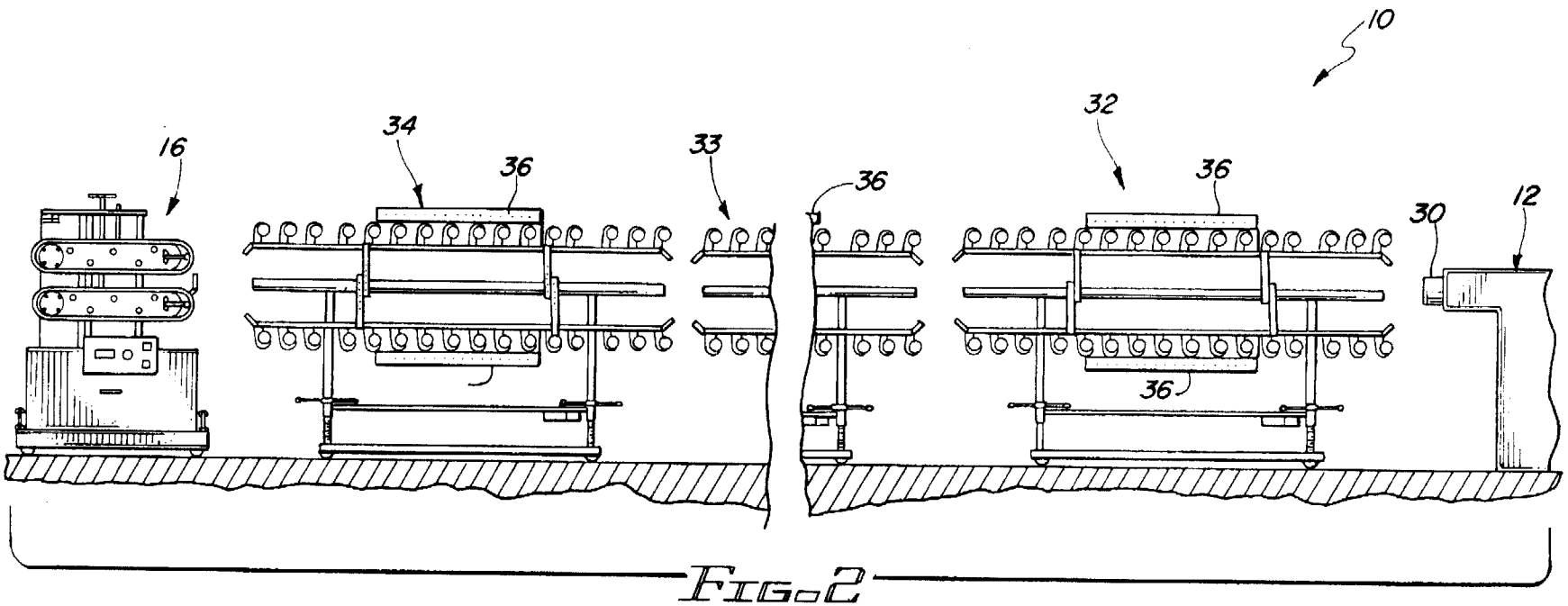
FIG. 2 is a side elevation which generally illustrates the extrusion and cooling stations of the in-line production assembly.

Referring to FIG. 2, the extrusion and cooling assembly of the in-line production assembly 10 is shown in more detail. Specifically, the heated thermoplastic material exits the extruder 12 through a die head 30 structured to define the general configuration of the extrusion profile. In a preferred embodiment, the extrusion profile is of a transverse cross-sectional configuration and dimension adapted for use as a louver vane for window covering assemblies. The continuous length of extrusion profile exiting the extruder 12 is directed along a series of sizing tables 32, 33 and 34. Each of the sizing tables are provided with upper and lower blowers 36 to cool the extruded thermoplastic material as it advances along the production line assembly 10 towards the hauling tension apparatus 16.

Figure 3:
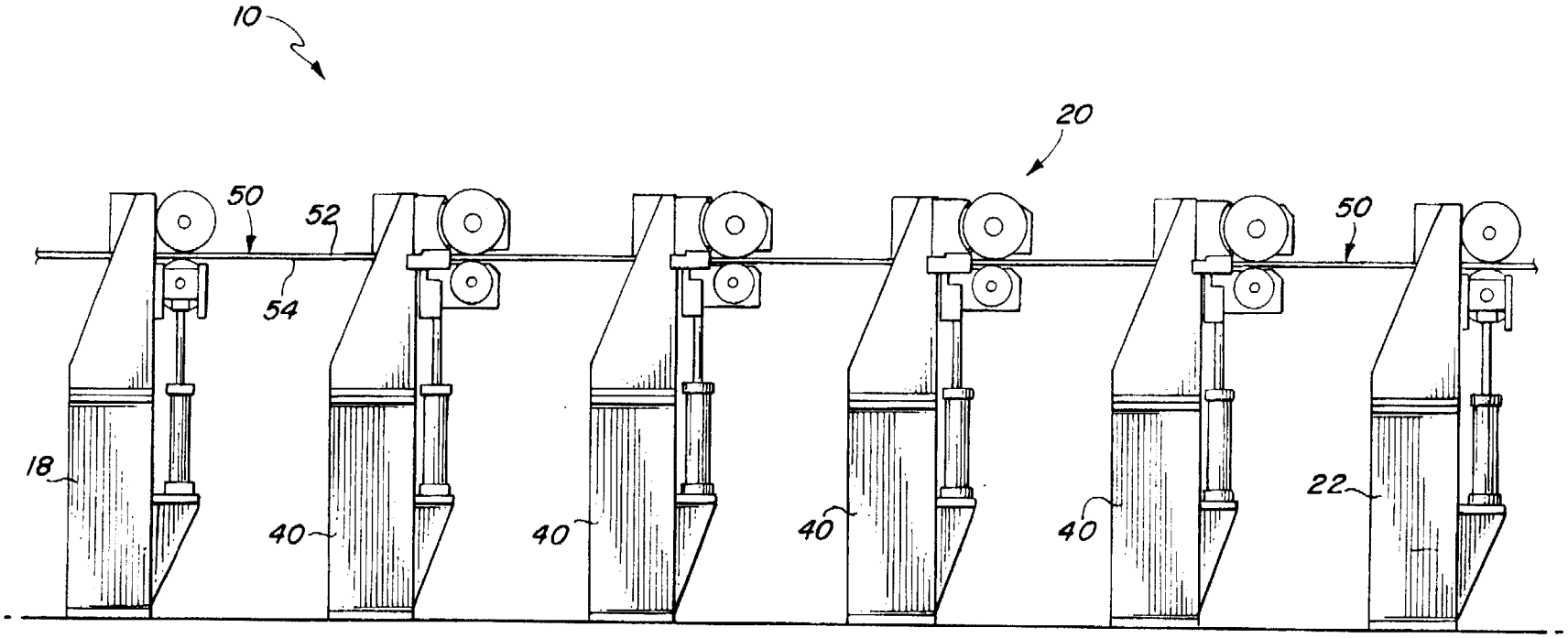
FIG. 3 is a side elevational view which generally illustrates the printing station of the in-line production assembly.

FIG. 3 generally illustrates the printing apparatus 20 and web tensioners 18, 22 at opposite ends of a series of printing machines 40 disposed in spaced arrangement along the production line assembly 10. As described above, the web tensioners 18 and 22 maintain and regulate the speed and tension of the profile 50 so that the printers 40 can maintain proper registration and apply a printed ink design on the top face 52 and/or bottom face 54 of the profile 50.

Figure 5:
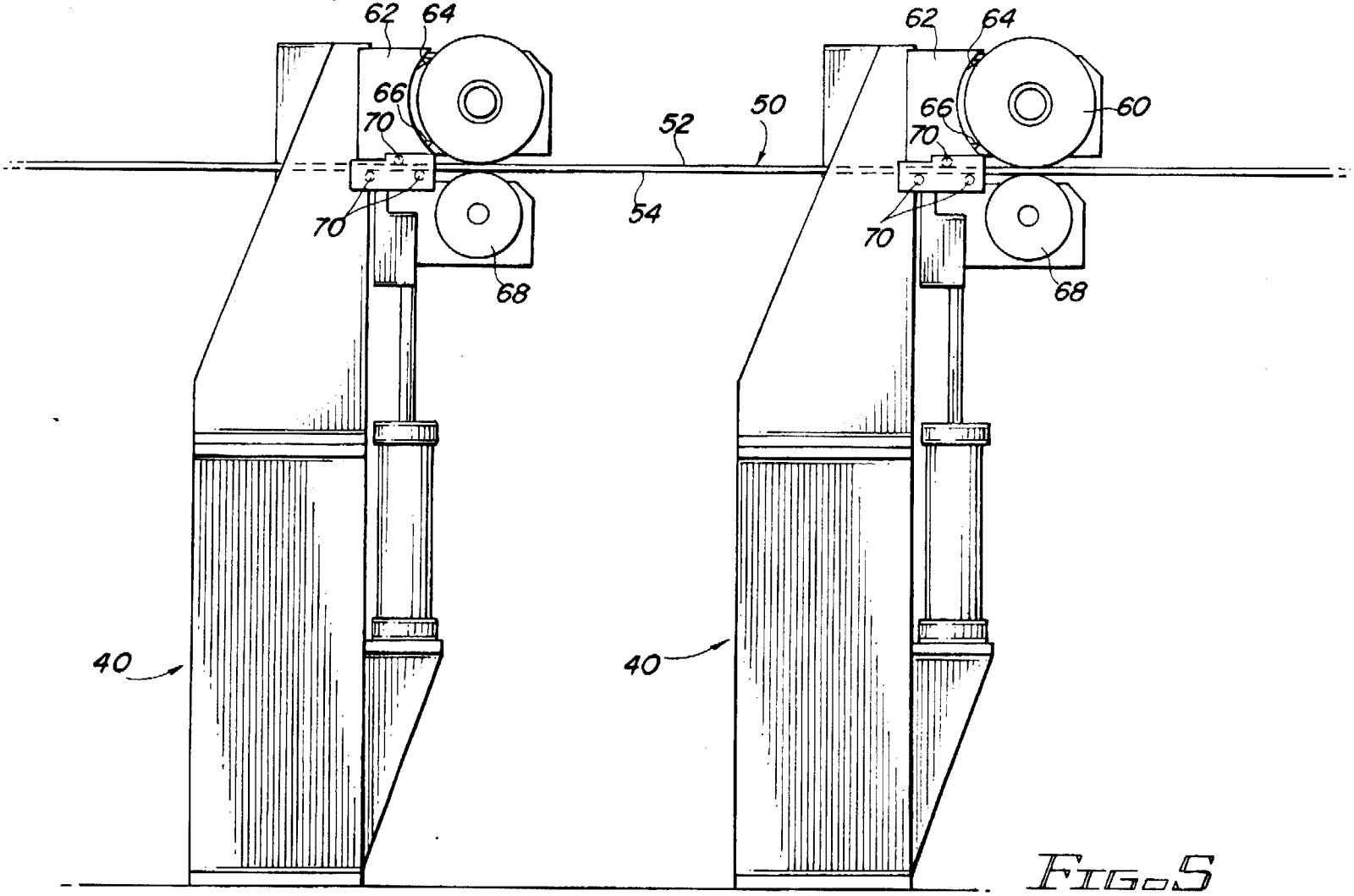
FIG. 5 is a side elevation showing a detailed illustration of two adjacently positioned printing machines along the printing station in accordance with a preferred embodiment.
Figure 6:
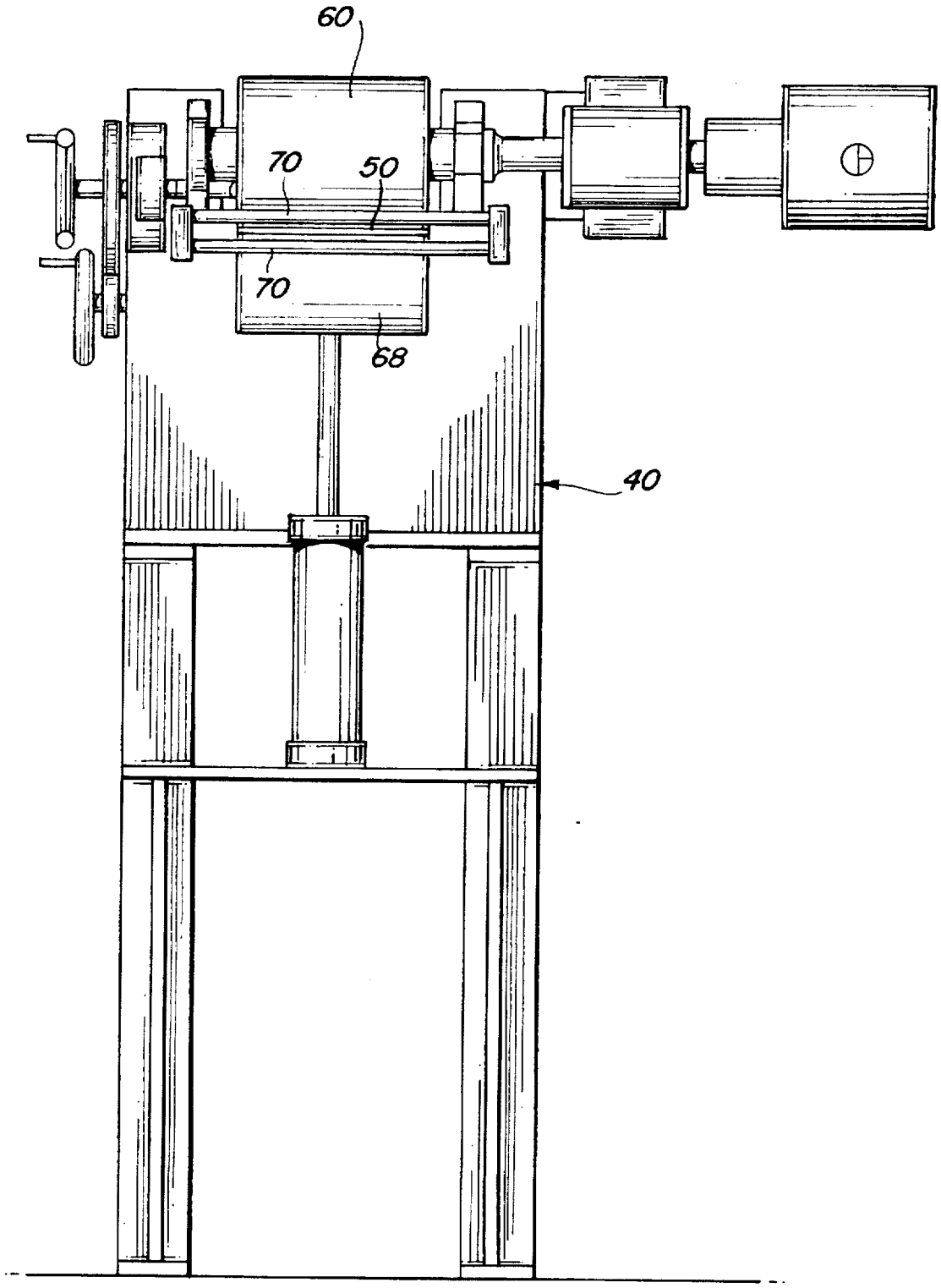
FIG. 6 is a front elevational view of a printing machine in accordance with the preferred embodiment.

In one preferred embodiment, the printing machines 40 are gravure-type printers, as shown in FIGS. 5 and 6. In this particular embodiment, the gravure printers 40 include a printing cylinder 60 which picks up ink within an ink chamber 62. The ink chamber is surrounded with top, bottom and side doctor blades which engage the surface of the printing cylinder 60 and maintain the ink within the chamber 62. FIG. 5 shows the top doctor blade 64 and the bottom doctor blade 66. As the printing cylinder 60 rotates to pick up ink, the bottom doctor blade 66 wipes off excess ink from the surface of the printing cylinder prior to the inked printing cylinder surface contacting the profile 50. In FIG. 5, the printing cylinders 60 are shown engaging the top face 52 of the profile 50. Each printing machine 40 contains a different color ink within the respective ink chamber 62 so that as the profile 50 advances through the series of printing machines 40, a multi-colored decorative design is produced on the top and/or bottom faces 52, 54 of the profile 50.

The printing machines 40 further include an impression cylinder 68 positioned in opposing relation to the printing cylinder to support the profile 50 at the printing area, so that the printing cylinder 60 is able to press firmly against the top or bottom face 52, 54 of the profile 50. The impression cylinder 68 may be provided with a resilient outer cylindrical surface made of rubber or other materials of particular desired densities in order to absorb pressure from the printing cylinder and to increase the printing contact area on the profile 50.

In a preferred embodiment, each of the printing machines 40 may be further provided with nip flattener rollers 70 to take out any curvature in the profile 50 just prior to being received between the printing cylinder and impression cylinder so that the profile is maintained flat when applying the ink design thereto.

After printing and drying, the profile 50 is directed through a cutting punch 24 to cut the profile into segments of predetermined length, thus defining louver vanes which are deposited onto the dump table 26 and periodically dropped into a catch bin, packaging box, and the like, as described above.

Accordingly, a method for producing louver vanes having printed ink design on at least one side thereof has been described.

While the instant invention has been described in what is considered to be a preferred and practical embodiment thereof, it is realized that departures may be made within the spirit and scope of the method of the present invention which, therefore, should not be limited except as set forth in the following claims and within the doctrine of equivalents. Now that the invention has been described,

What is claimed is:

1. A method for producing a decorative window covering product, the method comprising the steps of:

extruding a thermoplastic material from an extrusion apparatus to form a profile having opposite faces;

pulling said profile along a straight path of travel;

partially cooling said profile;

applying at least one pigmented liquid ink composition directly to at least one of said opposite faces of said profile;

etching said at least one of said opposite surfaces of said extrusion profile to which said ink composition is applied;

drying said ink composition on said profile; and cutting said profile into segments.

2. A method as recited in claim 1 wherein said step of applying at least one pigmented liquid ink composition includes:

passing said profile through a printing apparatus; and printing directly onto at least one of said opposite faces of said profile.

3. A method as recited in claim 2 wherein said step of drying includes directing an air flow onto at least one of said opposite faces of said profile to which said ink has been applied.

4. A method as recited in claim 3 further including the step of maintaining tension on said profile while pulling said profile along said straight path of travel.

5. A method as recited in claim 4 wherein said thermoplastic material is a polyvinyl chloride composition.

6. A method for producing a decorative window covering product, the method comprising the steps of:

extruding a heated thermoplastic material from an extrusion apparatus at a temperature range of between 350° F. and 390° F. to form a continuous profile having opposite faces;

pulling said profile along a straight path of travel;

maintaining tension on said continuous profile;

partially cooling said profile to a temperature range of between 90° F. and 250° F.;

applying at least one pigmented liquid ink composition directly to at least one of said opposite faces of said profile to produce a design or pattern thereon;

etching said at least one of said opposite surfaces of said extrusion profile to which said ink composition is applied;

maintaining tension on said profile during said step of applying at least one pigmented liquid ink composition;

drying said applied pigmented liquid ink composition on said profile; and cutting said profile into segments.

7. A method as recited in claim 6 wherein said step of applying at least one pigmented liquid ink composition includes:

passing said profile through a printing apparatus; and printing directly onto at least one of said opposite faces of said profile.

8. A method as recited in claim 7 wherein said step of drying includes directing an air flow onto at least one of said opposite faces of said profile to which said ink has been applied.

9. A method as recited in claim 1 wherein said step of etching includes:

causing a chemical reaction between said pigmented liquid ink composition and said thermoplastic material.

10. A method as recited in claim 6 wherein said step of etching includes:

causing a chemical reaction between said pigmented liquid ink composition and said thermoplastic material.

* * * * *